US008262833B2

(12) United States Patent
Dyal et al.

(10) Patent No.: US 8,262,833 B2
(45) Date of Patent: Sep. 11, 2012

(54) USE OF INFRARED TECHNOLOGY TO INSTALL AND/OR REPAIR CONSTRUCTION MEMBRANES

(75) Inventors: Ansil Dyal, South Ozone, NY (US); Louis Grube, Bound Brook, NJ (US); Edward Nebesnak, Mine Hill, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 244 days.

(21) Appl. No.: 11/827,863

(22) Filed: Jul. 12, 2007
(Under 37 CFR 1.47)

(65) Prior Publication Data

US 2009/0017226 A1 Jan. 15, 2009

(51) Int. Cl.
*B29C 65/00* (2006.01)

(52) U.S. Cl. ..... 156/272.2; 156/379.6

(58) Field of Classification Search ..... 156/71, 156/272.2, 379.6, 379.8, 380.9
See application file for complete search history.

(56) References Cited

U.S. PATENT DOCUMENTS

| | | | | |
|---|---|---|---|---|
| 2,084,625 | A * | 6/1937 | Stebbins et al. | 156/152 |
| 3,937,640 | A * | 2/1976 | Tajima et al. | 156/71 |
| 4,061,519 | A * | 12/1977 | Hammer | 156/244.17 |
| 4,714,509 | A * | 12/1987 | Gruber | 156/272.2 |
| 4,806,194 | A * | 2/1989 | Wald | 156/379.8 |
| 4,834,828 | A | 5/1989 | Murphy | |
| 4,855,004 | A * | 8/1989 | Chitjian | 156/359 |
| 5,148,799 | A * | 9/1992 | St-Louis et al. | 126/271.2 A |
| 5,353,782 | A | 10/1994 | Morris | |
| 6,451,152 | B1 | 9/2002 | Holmes et al. | |
| 6,536,498 | B1 | 3/2003 | Srinivasan et al. | |
| 6,583,202 | B1 * | 6/2003 | Grube et al. | 524/68 |
| 6,588,475 | B1 | 7/2003 | Simon, Jr. et al. | |
| 2003/0082870 | A1 | 5/2003 | Srinivasan et al. | |
| 2006/0037710 | A1 | 2/2006 | Vaillancourt | |

FOREIGN PATENT DOCUMENTS

JP 61115728 A * 6/1986

* cited by examiner

*Primary Examiner* — Daniel McNally
(74) *Attorney, Agent, or Firm* — Sills Cummis & Gross P.C.

(57) ABSTRACT

An apparatus is provided for applying a construction material, the apparatus having construction and an infrared heat emitter for providing infrared heat on the construction material. The construction material can be a roll of roofing material, which can be a roll of modified asphalt/bitumen roofing membrane material. The infrared emitter can be gas powered or electric powered. A method of applying a roofing membrane is also provided, where construction material is heated using infrared heat and applied onto a rooftop or other suitable surface.

12 Claims, 3 Drawing Sheets

USE OF INFRARED TECHNOLOGY TO INSTALL AND/OR REPAIR CONSTRUCTION MEMBRANES

BACKGROUND OF THE INVENTION

1. Field of the Invention

The present invention relates generally to the installation and/or repair of construction material or membranes, and more specifically, the use of infrared technology to install and/or repair the construction material or membranes.

2. Prior Art

There are several known and established methods of installing thermoplastic roofing, waterproofing and construction membranes either in roll form or in cut pieces commonly practiced in the construction industry today. One method widely used to heat these construction membranes during installation is called "torching" and uses an open flame to heat the back surface and overlapping seams of the thermoplastic rolls or pieces of membrane so that proper bonding or welding is achieved between the overlapping thermoplastic membranes, and between the membrane and decking material.

Heating of the thermoplastic construction membranes is typically carried out by use of hand held propane gas burners or torches. When the flame from these torches, which has a typical temperature of 1,800 to 2,500 degrees Fahrenheit, is directed towards the bottom surface and overlapping seams of the sheet, compound from the surfaces reach a molten state and bond together to form a strong waterproofing seal. Subsequently, the molten compound from the membranes back flows onto the deck and when cool forms a strong bonded seal.

The use of a cart with multiple propane torches is often referred to as a "dragon wagon", and can be used to weld and bond thermoplastic construction membranes together in the field. The applicator uses a wheeled carriage supporting a bottom roll mounting system and a series of propane torches for heating the entire width of the roll, as shown in U.S. Patent Publication No. US 2006/0037710 A1, which describes an alternate machine to apply roll products. However, the use of such a cart can also have some safety concerns associated with them if not used properly. These wagons use an open flame that can be left on when the cart is stopped, and detail work, flashing and other construction details still require the use of hand held open flame torches as shown in U.S. Pat. No. 5,353,782.

It is obvious that torching can be dangerous considering the risk of fire caused by the utilization of a torch and other similar equipment. Further, bonding or welding can be inconsistent depending on installer experience, flame temperature, heating time, weather conditions or degree of heating. Fire related concerns and other safety issues have led to the recent outlawing/prohibition of open flames in many municipalities, cities and towns. Banning of open flames has affected the installation and repair of modified asphalt/bitumen roofing membranes where its installation is hindered or banned. Alternate heating devices using hot air to weld only the seams of thermoplastic construction membranes have been invented (as shown in U.S. Pat. No. 6,588,475 B1), but have limited use due to labor and time needed to secure the membrane to the deck and the time it takes to make a weld or bond overlapping sheets together. Such devices may require two to three times the time required to lay a roll of thermoplastic material using hot air.

Similarly, hot mopping, in which drums or cartons of hot asphalt are used, although posing a reduced risk of fire versus torch application, still poses an operational problem. Hot-mopping application, which requires a fair amount of labor, especially in larger projects, also results in waste cartons with chemical residue. Cartons of asphalt weighing up to 50 pounds are split and heated in a kettle. The kettles are usually heated with propane gas and can also be a safety and fire hazard as hot asphalt could splash onto a worker as the asphalt is added to the kettle or the kettle is overheated and the asphalt reaches its' flashpoint and ignites causing a fire. These dirty cartons must be disposed of properly, for example, in landfills, and may become unsafe for the environment. In addition, disposal of the waste materials can become costly and labor-intensive. The hot asphalt is then pumped from the kettle to a mop bucket on the roof using a hose so that it can be applied at temperatures from 400-475 degrees Fahrenheit. Alternatively, hot asphalt is pumped directly from a hot asphalt tanker truck to the roof from the ground also using a hose. The use of a hose can cause other problems and safety concerns in that it is very difficult and dangerous to pump hot asphalt to the roof level, especially in the case of high-rise buildings.

Cold adhesives generally come in buckets or pressurized spray systems. Use of cold adhesive poses its own problems related to disposal of empty buckets or aerosol cans. Additionally, cold adhesives contain solvents that are not desirable from an environmental point of view. For example, they produce volatile organic compounds or VOCs and these emissions can be harmful to the environment and to people. Moreover, there is a potential for the release of airborne pollutants with this system of application.

Several of these construction membrane system compositions are well known. However, these products are based on application methods that pose environmental and operational hazards during the application of the construction membrane. Furthermore, the end result of the above-described in field applications is not successful each and every time. There is, therefore, a need to provide a construction membrane which provides a safer method of installation, reduces labor and installation costs, provides good bonding properties, reduces VOCs and emissions from hot mopped or adhesives that contain solvents for roofing membrane applications.

Infrared (IR) radiation is electromagnetic radiation of a wavelength longer than that of visible light, but shorter than that of radio waves. Infrared radiation has wavelengths between about 750 nm and 1 mm, spanning three orders of magnitude. Infrared radiation is popularly known as "heat" or sometimes "heat radiation," since many people attribute all radiant heating to infrared light. This is a widespread misconception, since light and electromagnetic waves of any frequency will heat surfaces that absorb them. Infrared light from the Sun only accounts for 50% of the heating of the Earth, the rest being caused by visible light that is absorbed then re-radiated at longer wavelengths. Heat is energy in transient form that flows due to temperature difference.

Infrared is used in various applications. The uses of infrared include military, such as: target acquisition, surveillance, homing and tracking and non-military, such as thermal efficiency analysis, remote temperature sensing, short-ranged wireless communication, spectroscopy, night vision, thermography, heating, communications, imaging, climatology, meteorology, astronomy and weather forecasting. However, the use of infrared technology has not been used in applications such as provided for in the present invention.

The present invention provides a new use of infrared technology and permits a safer, economical and more simplified, roof, waterproofing and construction material installation without compromising structural integrity. It also offers a suitable means to dramatically reduce field labor, which eliminates the numerous undesirable aspects of the prior art.

SUMMARY OF THE INVENTION

The present invention provides for the use of infrared technology to install and/or repair construction products or membranes in rolls or pieces whether cut or manufactured to themselves or to various surfaces, such as but not limited to roofs, decks, sidewalks, roads, floors or other suitable surfaces using heat to weld or activate the membranes or an adhesive. The construction material can be a thermoplastic roofing material or membrane, waterproofing material or other type of construction material. The thermoplastic membrane can comprise but is not limited to polymeric membranes such as polyvinylchloride (PVC), thermoplastic olefins (TPO), polypropylene or polyethylene and combinations thereof and/or asphaltic based membranes with or without polymeric additives, plasticizers, mineral fillers or stabilizers.

Accordingly, the present invention provides an apparatus for applying a construction material, the apparatus comprising a roll or piece of construction material and heating means for providing infrared heat on the construction material. The apparatus further comprises a motor for powering the heating means. The construction material can be any thermoplastic roofing, waterproofing or construction material such as but not limited to Built-Up Roofing or BUR, thermoplastic (PVC) or thermoplastic olefin (TPO), or a modified asphalt/bitumen roofing membrane material or any combination thereof. The roll can also be made of any other material so that when heat is applied to the material it forms a bond to the surface it is being applied to or to itself or a construction material with a factory or field applied adhesive or pressure sensitive adhesive that can be applied easier or faster using heat to activate or make the bond faster or better. For example, road markings and cross walks can be applied by use of a heat-activated material.

The heating means can be an infrared emitter, which can be gas powered or electric powered. The apparatus for applying a construction membrane can further comprise a set of wheels for making the apparatus mobile. The apparatus can further comprise one or more handles for steering the apparatus. The apparatus can have a blower fan to move hot air to heat a back of the construction material, and a control mechanism to ignite, regulate the heat and turn off the heating means.

The apparatus can further comprise a positioning roll to keep the construction material a fixed distance from the heating means, and a weighted press roll for pressing the construction material onto a surface.

Further, a method of applying a membrane is provided, the method comprising heating a roll of construction material using infrared heat, and applying the construction material on a roof, deck or other suitable surface. The method further comprises bonding or welding the membrane using infrared heat, regulating and controlling the heat applied to the construction material, and moving hot air to heat a back of the construction material.

Further provided is a method of applying a construction material, the method comprising laying construction material on a surface, pulling back a portion of the construction material to expose a bottom side of the construction material, heating the back of the construction using infrared heat, and applying the construction material on the surface.

The above and other features of the invention, including various novel details of construction and combinations of parts, will now be more particularly described and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of membranes, it has been found particularly useful in the environment of installation and/or repair of construction membranes. Therefore, without limiting the applicability of the invention to the above, the invention will be described in such an environment.

Figure 1:
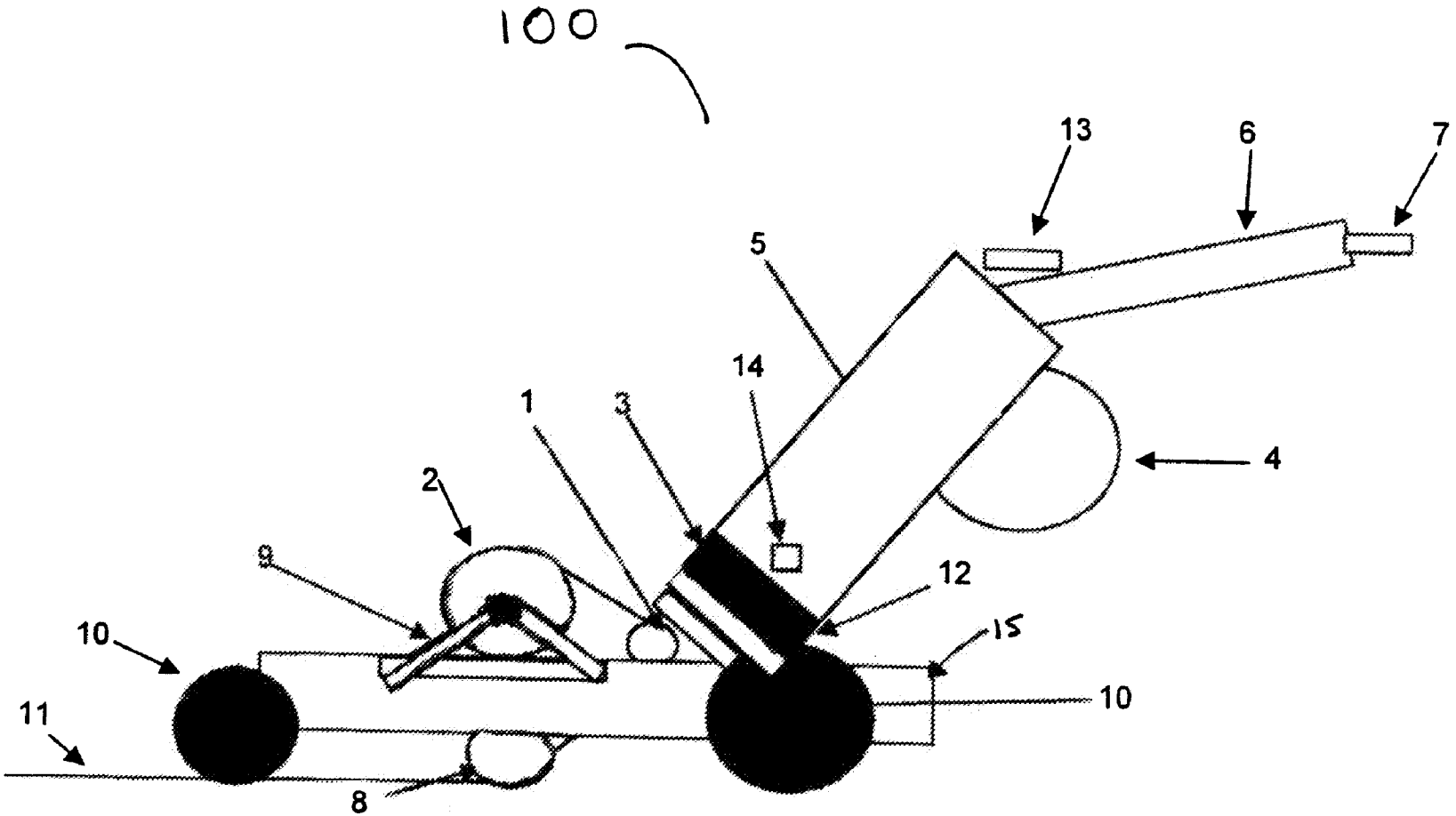
FIG. 1 illustrates a side view of one embodiment of an apparatus used for the application of a construction material.

FIG. 1 illustrates a side view of a mobile apparatus 100 in accordance with the present invention. The mobile apparatus 100 has a control box 13 having controls for powering the unit on/off as well as other electronic functions, a handle 6 for steering the mobile apparatus 100, and an air/gas inlet or electrical cord 7.

A housing 5 provides for an infrared emitter/heater 3, a motor 12, and an igniter 14 (which can be an auto-ignited). The motor 12 can provide power for the infrared emitter 3. These elements are preferably located inside the housing 5. A fan/blower 4 can be provided for on the outside of the housing 5. The controls on the control box 13 can be used to ignite, regulate the heat and turn off the infrared emitter/heater 3.

A carriage 15 can provide a roll support/bracket 9 which holds construction material 2. Construction material 2 can be provided in the form of a roll of construction material. The construction material 2 can be thermoplastic material, waterproofing material and/or roofing material, such as a modified asphalt/bitumen roofing membrane. The construction material 2 can be provided in a roll as shown or in any other form.

A positioning roll 1 can be provided on the carriage 15 to keep the construction material 2 a fixed distance from the infrared emitter 3. A weighted press roll 8 presses the construction material 2 once it is applied to a surface. The carriage 15 also provides for wheels 10 for movement of the mobile apparatus 100. Preferably, the apparatus has two front wheels and two back wheels, but is not limited to such and can have different combinations of wheels and/or other means of mobility.

Figure 2:
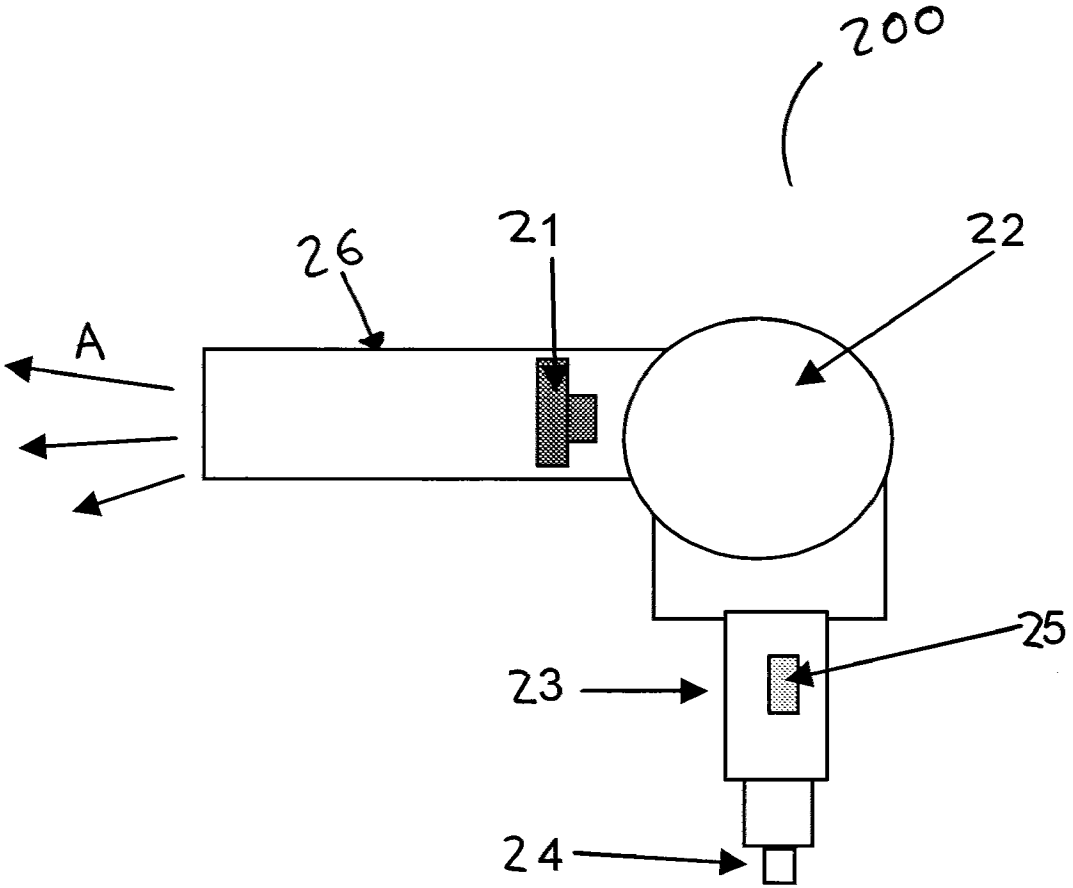
FIG. 2 illustrates a side view of another embodiment of an apparatus used for the application of a construction material.

FIG. 2 illustrates another embodiment of a mobile apparatus 200 for providing infrared heat on a construction material, where wheels may not be necessary. An infrared emitter 21 is provided for inside the housing 26 of the apparatus 200. A blower fan 22 blows air to direct the infrared heat in the direction A. A handle 23 can be held by the user, where controls and an on/off switch 25 can also be provided. A gas/air inlet or electrical cord 24 is also provided.

Figure 3:
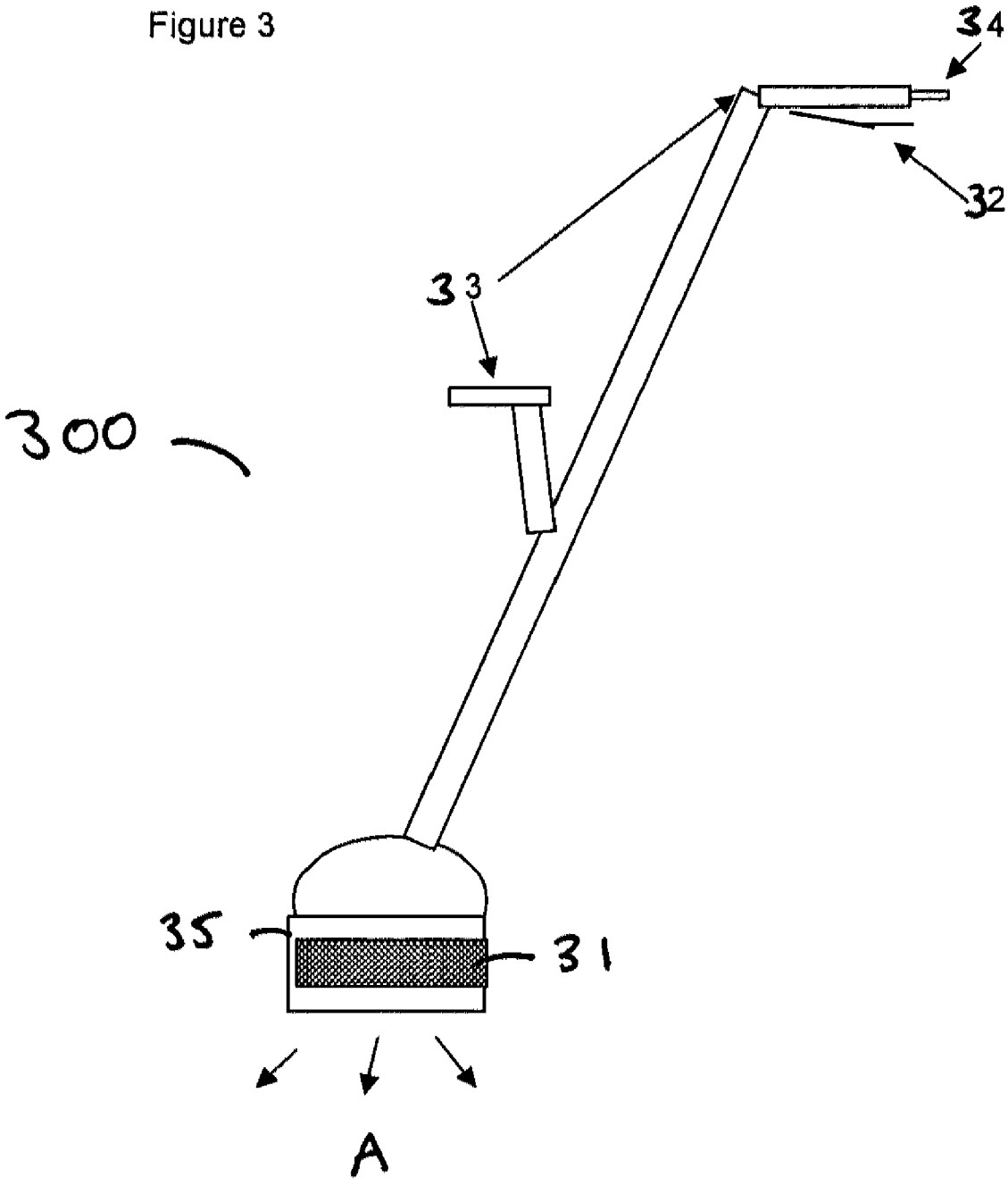
FIG. 3 illustrates a side view of another embodiment of a hand-held apparatus used for the application of a construction material.

FIG. 3 illustrates another embodiment of a hand-held mobile apparatus 300 for providing infrared heat on a construction material. In this embodiment, controls are provided along one or more handles 33 to steer and guide the unit 300, and wheels may not be necessary. The user can place their hands on handles 33 to steer and guide the unit 300 as the construction material is provided on a surface. The infrared emitter 31 is provided for inside the housing 35 of the apparatus 300. A gas/air inlet or electrical cord 34 is also provided, along with a safety shut-off 32.

The operation settings and application mode of the mobile apparatus can be manual, semi-automatic or automatic mobile unit to facilitate the heating/melting of a modified asphalt/bitumen roofing membrane. The infrared emitter/heater can be either electric or gas powered. The gas infrared emitter/heater would be powered by a propane source, such as a propane tank. The electric heater/emitter can be powered by an electric source having voltage in a range of 110-240 V, 30-90 amps producing 1000-2500 watts, but is not limited to such. The mobile apparatus is a mobile unit and can easily be transported and taken onto a roof.

In operation, as shown in FIG. 1, the motor 12 provides power to an infrared emitter/heater 3, used to melt and/or cause the flow of the modified asphalt/bitumen roofing membrane 2 on a roof or on top of another roofing membrane 11. The emitter/heater 3 provides heat on a back side of the construction material that touches the deck or surface. The bracket 9 holds the roll of roofing membrane 2 in place and the positional roll 1 keeps the roll of roofing membrane 2 a fixed distance from the infrared emitter 3. Once the infrared emitter 3 heats the roofing material 2 to a certain temperature, the roofing material 2 melts and flows in its molten, flowing state onto either an underlayment, plywood or another modified bitumen membrane 11 (base sheet). It is the melted roofing material which provides the adhesive bond.

Subsequently the infrared emitter 3 can be positioned once the first roll is applied to head the applied roll seaming area at the same time it is heating the back of the new roll of roofing membrane so that both the seam area of the first roll and the back area of the new roll become molten and bond together. Furthermore, as the roofing membrane 2 is applied onto the membrane 11, the carriage 15 is weighted (using a weighted press roll 8) to help make a better bond between the applied roll 11 and the new roll 2 being applied. The blower fan 4 can be used to move hot air to heat a back of the roofing membrane 2.

In FIGS. 2 and 3, the apparatus would be used to provide infrared heat on an applied area of construction material on a rooftop or such other surface. Once the construction material is cut to size and applied on the roof, a portion of the construction material can be lifted to expose the bottom side of the construction material. Infrared heat can be applied to the bottom side of the construction material to heat it using the apparatus described in FIGS. 1 and 2. The construction material can then be laid on the deck, and then pressed from the top.

This procedure was performed and different experiments conducted using a propane emitter in place of a roofing torch. The chart below shows five different trials using the propane emitter to melt the membrane. Trials 1 and 2 were performed with membranes made with Styrene-Butadiene-Styrene (SBS), asphalt and mineral stabilizers, and Trials 3, 4 and 5 were performed on a membrane made with primarily an Atactic Polypropylene (APP), asphalt, other thermoplastic modifiers and mineral stabilizers.

| | Trial #1 | Trial #2 | Trial #3 | Trial #4 | Trial #5 |
|---|---|---|---|---|---|
| Membrane type | SBS | SBS | APP | APP | APP |
| Membrane (roll) size | 40" × 5" | 40" × 5" | 40" × 5" | 40" × 5" | 40" × 5" |
| Area heated | 8" × 5" | 8" × 5" | 8" × 5" | 8" × 5" | 8" × 5" |
| Distance between Emitter 60 & Roofing Material 70 | 3" | 6" | 6" | 6" | 3" |
| Emitter 60 temperature | 1800° F. | 1800° F. | 1800° F. | 1800° F. | 1800° F. |
| Temperature of roll 70 before heating | 86° F. (30° C.) | 86° F. (30° C.) | 86° F. (30° C.) | 86° F. (30° C.) | 86° F. (30° C.) |
| Temperature at roll surface 90 | 360° F. (182° C.) | 345° F. (174° C.) | 460° F. (238° C.) | 430° F. (221° C.) | 395° F. (202° C.) |
| Time taken at roll surface 90 to flow/melt | 9.65 seconds | 10 seconds | 17 seconds | 15 seconds | 6.81 seconds |

The trials illustrate that it is very feasible to heat the surface of a SBS or APP modified membrane to its melting or flow point in order that a strong bond can be made and that rate of heating can be controlled by the position of the emitter. It is also feasible to control rate of melting by controlling the temperature of the emitter. A propane roofing torch held at similar distances would show similar melting results. SBS or elastomeric modified membranes in general do not melt and flow like thermoplastic membranes do, and soften and are bonded together with some pressure. SBS membranes have lower softening points in general which is reflected in the tables.

For the SBS membrane, in Trial #1, at the 3" distance after surface melting was observed, the surface temperature was measured at 360° F. In Trial #2, at the 6" distance after surface temperature was observed to be visually melted, the surface temperature was measured to be 345° F. Both membranes were heated above their softening point of about 245° F. and could weld to the roof or each other.

For the APP modified membranes, the surface was visually seen to be melted and temperature using an IR heat detector measured the surface temperature. Time and temperatures were recorded. The closer the heat source, the faster the APP membrane melted above the softening point of 305° F. This trial confirms that the IR heater used for this trial had enough heat capacity to melt the surface of the membrane in a fast and suitable time frame.

The present invention provides several advantages that solve the problems with prior art methods. It provides a safe form of heating the construction material, eliminating the need for torching and open flame environments, which are generally unsafe. If further provides an easily transportable and mobile device. The infrared emitter/heater is safe and shielded away from the operator, if one is being used, and quickly heats the construction material causing it to melt/flow.

The infrared emitter is not limited to a heater but can be any type of source that provides infrared heat. Further, the construction material can be applied to a roof, deck or siding membrane. Any construction material that can be melted using an infrared heater can be used.

The above description of the present invention is only the preferred embodiment of the invention. The tables and examples given are just examples and do not limit the invention to the particular temperatures, sizes of roofing membranes, types of roofing membranes or to the times given and described therein.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An apparatus for applying a construction material directly to a surface, wherein the construction material comprises a roll of roofing material that is chosen from a thermoplastic material, a waterproofing material or a modified asphalt/bitumen roofing membrane material; the apparatus comprising a handle; and heating means for providing infrared heat on a back side of the construction material that touches the surface, wherein the infrared heat contacts the back side of the construction material as it moves along the curved edge of a positioning roll such that when the apparatus is pulled by its handle, the construction material unrolls, is heated on the back side by the heating means and adhered to the surface; and a motor for powering the heating means.

2. The apparatus for applying a construction material of claim 1, wherein the heating means comprises an infrared emitter.

3. The apparatus for applying a construction material of claim 2, wherein the infrared emitter is gas powered.

4. The apparatus for applying a construction material of claim 2, wherein the infrared emitter is electric powered.

5. The apparatus for applying a construction material of claim 1, further comprising:

a weighted press roll for pressing the construction material onto the surface.

6. The apparatus for applying a construction material of claim 1, further comprising:

a set of wheels for making the apparatus mobile.

7. The apparatus for applying a construction material of claim 1, further comprising:

a blower fan to move hot air to heat a back of the construction material.

8. The apparatus for applying a construction material of claim 1, further comprising:

a control mechanism to ignite, regulate the heat and turn off the heating means.

9. The apparatus of claim 1, wherein the surface is chosen from an underlayment, plywood, a thermoplastic membrane, a waterproofing membrane or a modified asphalt/bitumen membrane.

10. A method of applying a construction material directly to a surface, the method comprising:

heating a construction material using infrared heat, wherein the infrared heat contacts the construction material as it moves along the curved edge of a positioning roll;

applying the construction material on the surface;

regulating and controlling the heat applied to the construction material;

moving hot air to heat a back of the construction material; and bonding or welding the construction material directly to the surface using infrared heat.

11. The method of applying a construction material of claim 10, wherein the construction material comprises a roofing, siding or decking membrane.

12. The method of claim 10, wherein the method is a method of applying a construction material directly to a surface chosen from an underlayment, plywood, a thermoplastic membrane, a waterproofing membrane or a modified asphalt/bitumen membrane.

* * * * *